United States Patent [19]

Schill et al.

[11] Patent Number: 4,995,790

[45] Date of Patent: Feb. 26, 1991

[54] VERTICAL BARREL PUMP

[75] Inventors: Jürgen Schill, Weisenheim; Hans F. Heene, Gerolsheim; Rainer Stahl, Frankenthal; Friedrich Weber, Bobenheim-Roxheim, all of Fed. Rep. of Germany

[73] Assignee: Klein, Schanzlin & Becker Aktiengesellschaft, Frankenthal, Fed. Rep. of Germany

[21] Appl. No.: 855,884

[22] Filed: Apr. 24, 1986

[30] Foreign Application Priority Data

Apr. 30, 1985 [DE] Fed. Rep. of Germany ..... 3515547

[51] Int. Cl.[5] ..... F04B 39/14

[52] U.S. Cl. ..... 417/360; 417/361

[58] Field of Search ..... 417/361, 360; 248/56

[56] References Cited

U.S. PATENT DOCUMENTS

| | | | |
|---|---|---|---|
| 2,792,158 | 5/1957 | Veitch, Sr. et al. | 417/361 |
| 3,149,472 | 9/1964 | McCall et al. | 417/361 |
| 4,259,542 | 3/1981 | Tehan et al. | 248/56 |
| 4,630,415 | 12/1986 | Attwell | 248/56 |

*Primary Examiner*—Leonard E. Smith
*Assistant Examiner*—Eugene L. Szczecina, Jr.
*Attorney, Agent, or Firm*—Peter K. Kontler

[57] ABSTRACT

A vertical barrel pump wherein the barrel casing is not provided with an integral flange. The flange is a separately produced part whose upper side is engaged by an external shoulder of the barrel before the pump housing is mounted in and is attached to the barrel by way of the flange. The flange can constitute a base plate which is made of reinforced concrete and is embedded in the foundation of the barrel pump.

1 Claim, 3 Drawing Sheets

VERTICAL BARREL PUMP

BACKGROUND OF THE INVENTION

The invention relates to improvements in so-called barrel pumps, and more particularly to improvements in vertical barrel pumps.

Barrel pumps (also known as double casing pumps or jacket casing pumps) are centrifugal pumps surrounded by a barrel-shaped casing. The barrel is equipped with a suction nozzle and sometimes also with a discharge nozzle, and is tightly bolted together with a radially split cover. The drive shaft passes through the cover and is sealed by a shaft seal. When the pump is dismantled, the barrel casing can remain in situ and, in accordance with heretofore known proposals, can remain connected to the piping and to the pump foundation. Barrel pumps are usually multistage vertical or horizontal pumps and, as a rule, are used as high-pressure and very high-pressure pumps, particularly as boiler feed pumps.

In accordance with heretofore known proposals, the barrel of a barrel pump is integral with a flange which rests on a metallic frame. The latter is installed in a concrete foundation The frame carries four screws and is oriented subsequent to insertion of the barrel into the foundation. In the next step, the frame is permanently installed (encased or embedded) in the foundation. Such mode of installing a barrel pump is cumbersome, time-consuming and expensive.

OBJECTS AND SUMMARY OF THE INVENTION

An object of the invention is to provide a novel and improved vertical barrel pump which is simpler, more compact and less expensive than heretofore known barrel pumps.

Another object of the invention is to provide a vertical barrel pump wherein the barrel and the immediate support therefor can be made of different materials.

A further object of the invention is to provide a novel and improved base plate for use in the above outlined barrel pump.

An additional object of the invention is to provide a novel and improved method of making and assembling a vertical barrel pump.

Still another object of the invention is to provide a novel and improved barrel for use in the above outlined pump.

The invention is embodied in a vertical centrifugal pump which comprises an annular support, a discrete pump barrel which constitutes a separately produced part and extends through and has a shoulder resting on the support, and means for separably securing the barrel to the support. The shoulder is preferably an external annular shoulder of the barrel, and the securing means can comprise a plurality of discrete screws, bolts and nuts or other suitable fasteners.

The support can include or constitute a base plate which rests on and is preferably embedded in the foundation of the barrel pump. The base plate can comprise a preferably annular sleeve-like skirt which spacedly surrounds the barrel at a level below the support and is surrounded by an internal surface of the foundation.

The support can be made of concrete, preferably of metal-reinforced concrete or concrete polymer.

The novel features which are considered as characteristic of the invention are set forth in particular in the appended claims. The improved pump itself, however, both as to its construction and its mode of operation, together with additional features and advantages thereof, will be best understood upon persual of the following detailed description of certain specific embodiments with reference to the accompanying drawing.

BRIEF DESCRIPTION OF THE DRAWING

FIG. 4 is a fragmentary partly elevational and partly vertical sectional view of a barrel pump which embodies the invention; and FIG. 5 is an enlarged view of a detail in the barrel pump of FIG. 4.

DESCRIPTION OF THE PREFERRED EMBODIMENTS

Figure 1:
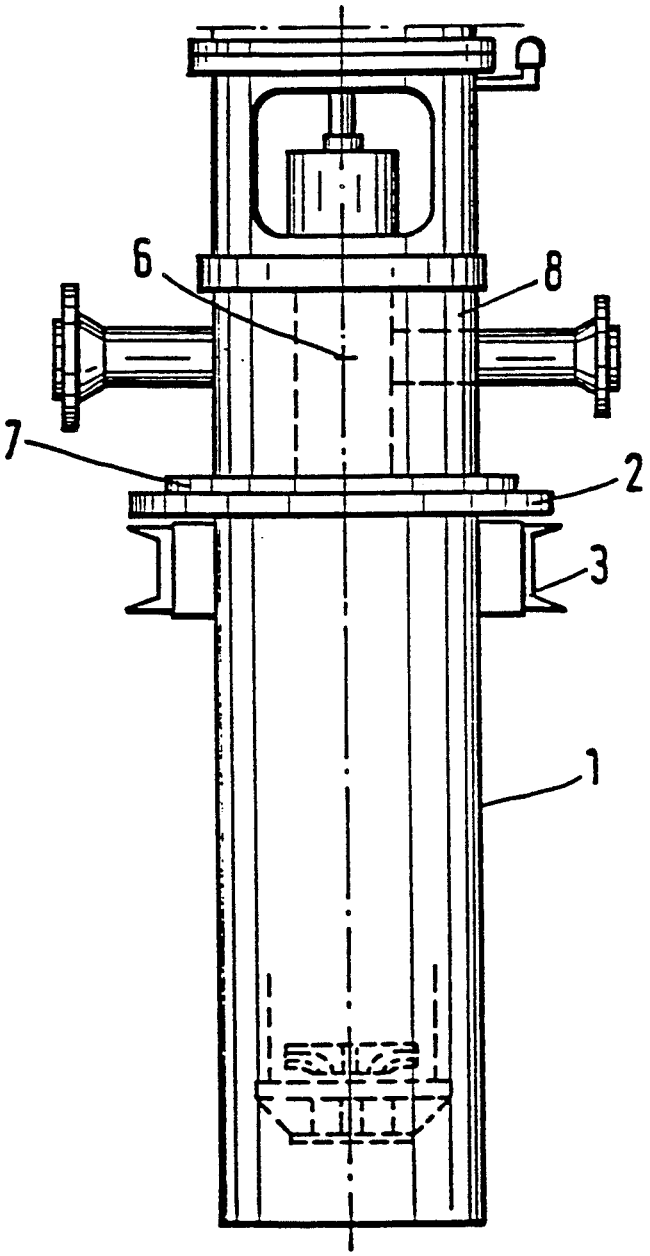
FIG. 1 is a schematic fragmentary elevational view of a conventional vertical barrel pump.
Figure 2:
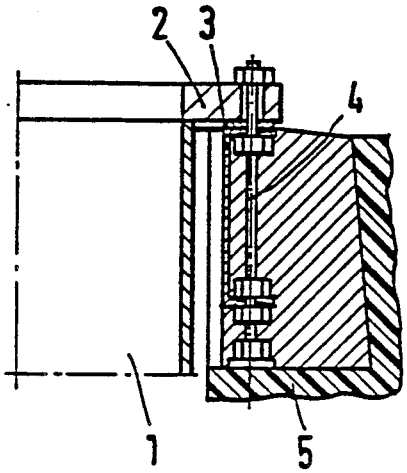
FIG. 2 is an enlarged fragmentary vertical sectional view of the conventional barrel pump.
Figure 3:
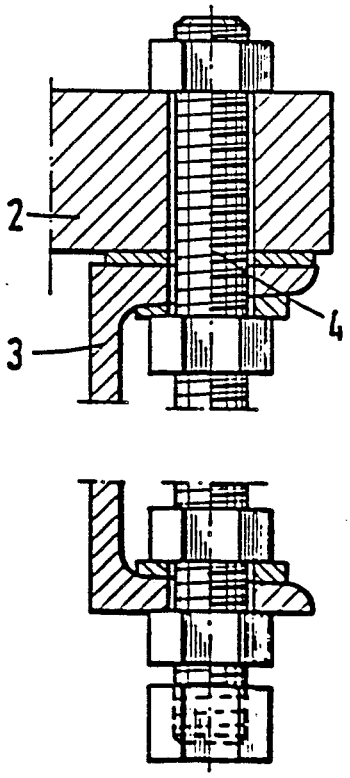
FIG. 3 is an enlarged view of a detail in the structure of FIG. 2.

FIGS. 1 to 3 show certain details of a conventional vertical barrel pump having a barrel 1 with an integral flange 2 which rests on a frame-like support 3. The frame 3 carries four vertical threaded fasteners 4 which secure it to the flange 2 as well as to a foundation 5. The barrel 1 is adjusted (centered) with reference to the frame 3 while the flange 2 is fully accessible. Adjustment of the frame 3 relative to the foundation 5 takes place subsequent to attachment of the flange 2 and prior to embedding the frame into the foundation 5, as a rule into a concrete foundation. The centrifugal pump 6 proper is thereupon inserted into the barrel 1 and the flange 7 of its housing 6 is bolted to the flange 2 of the barrel 1.

Certain features of one vertical barrel pump which embodies the present invention are shown in FIGS. 4 and 5. The flange 9 constitutes a discrete annular support for the housing of the pump 6 and the barrel 10. The latter is formed with an external annular shoulder 11 which rests on the upper side of the flange 9. The illustrated flange 9 can be said to constitute a base plate which replaces the frame 3 of the conventional barrel pump and is ultimately embedded in a suitable foundation 5 of the improved barrel pump. One or more shims 12 are used to properly orient and incline the support 9, and the latter is preferably provided with an integral or separable annular skirt 13 which surrounds the lower portion of the barrel 10 (at the level below the general plane of the support 9) and is surrounded by the internal surface 16 of the foundation 5. The insertion of one or more shims 12 takes place before the barrel 10 is lowered into the skirt 13, i.e., before the external shoulder 11 comes to rest on the support 9. The body of the centrifugal pump 6 is mounted on the flange 9 in a next-following step. The flange 14 at the lower end of the motor housing of the barrel pump embodying the structure of FIGS. 4 and 5 is thereupon secured to the flange 9 by a set of, for example, four equidistant fasteners 15 (indicated in FIGS. 4 and 5 by phantom lines). These fasteners secure the barrel 10 to other parts of the pump.

The flange 9 can be made of or it may contain concrete, particularly reinforced concrete, preferably concrete polymer. The reinforcement normally involves the insertion of metallic bars, rings or otherwise configurated reinforcing elements.

An important advantage of the improved pump is that the flange 9 can be produced separately at lower cost than a flange which is an integral part of a barrel. Moreover, the utilization of a discrete flange 9, which preferably also constitutes a base plate for other parts of the pump, simplifies the orientation of such flange relative to the foundation since the orientation merely involves an adjustment of the flange 9 alone rather than an adjustment of a bulky unit including a flange and a barrel. Still further, the provision of a discrete flange 9 contributes significantly to lower cost of the barrel pump because the flange can be readily designed as a base plate which replaces the frame 3 of a conventional barrel pump.

The skirt 13 constitutes a desirable but optional feature of the improved barrel pump. Its primary purpose is to shield the edge around the upper end of the internal surface 16 of the foundation 5.

A further important advantage of the flange 9 (which constitutes a separately produced part) is that its material need not be identical with the material of the barrel. As mentioned above, the flange 9 is preferably made of reinforced concrete, most preferably of concrete which is reinforced by metallic inserts which are embedded therein.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A vertical centrifugal pump comprising an annular support; a pump barrel extending through said support and having a peripheral wall defining a shoulder which rests on said support; and means for separably securing said barrel to said support; wherein said peripheral wall includes a first portion having a first wall thickness, and a second portion having a second wall thickness smaller than said first wall thickness, said first and second portions cooperating to define said shoulder; wherein said barrel is devoid of flanges.

* * * * *